US010309236B2

(12) United States Patent
Power

(10) Patent No.: US 10,309,236 B2
(45) Date of Patent: Jun. 4, 2019

(54) SUBSONIC SHOCK STRUT

(71) Applicant: Rolls-Royce Corporation, Indianapolis, IN (US)

(72) Inventor: Bronwyn Power, Brownsburg, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 1363 days.

(21) Appl. No.: 14/144,697

(22) Filed: Dec. 31, 2013

(65) Prior Publication Data

US 2015/0016983 A1 Jan. 15, 2015

Related U.S. Application Data

(60) Provisional application No. 61/783,604, filed on Mar. 14, 2013.

(51) Int. Cl.
*F01D 9/02* (2006.01)
*F01D 25/28* (2006.01)

(52) U.S. Cl.
CPC ..... *F01D 9/02* (2013.01); *F01D 25/28* (2013.01); *F05D 2240/124* (2013.01); *F05D 2250/70* (2013.01); *F05D 2250/713* (2013.01)

(58) Field of Classification Search
CPC ... F01D 9/02; F01D 9/23; F01D 9/065; F01D 25/28; F01D 25/16; F01D 25/162; F01D 5/141; F01D 5/142; F01D 5/147; F05D 2240/12; F05D 2240/121; F05D 2240/122; F05D 2240/123; F05D 2240/124; F05D 2240/125; F05D 2240/90; F05D 2240/91; F05D 2250/70; F05D 2250/72; F05D 2250/711; F05D 2250/712; F05D 2250/713
(Continued)

(56) References Cited

U.S. PATENT DOCUMENTS 2,516,819 A * 7/1950 Whittle ..... F01D 25/30 138/148
2,616,662 A * 11/1952 Mierley ..... F01D 9/065 415/199.5

(Continued)

FOREIGN PATENT DOCUMENTS

GB 1084184 A 12/1966

OTHER PUBLICATIONS

Lighthill, M. J., A New Method of Two-Dimensional Aerodynamic Design, Apr. 1945, 54 pages.

(Continued)

*Primary Examiner* — Jason Shanske
*Assistant Examiner* — Wayne A Lambert
(74) *Attorney, Agent, or Firm* — Barnes & Thornburg LLP

(57) ABSTRACT

A gas turbine engine strut has a forebody positioned upstream of a point of maximum thickness and an aft body positioned downstream of the point of maximum thickness. The aft body has a discontinuity in a curvature distribution which provides for a "subsonic shock." The discontinuity in curvature distribution can include in inflection point that marks a transition from a curvature associated with an upstream portion of the aft body to a second curvature associated with a downstream portion of the aft body. In some forms, the aft body can additionally include boundary layer aspiration. The gas turbine engine strut can be symmetrical about a centerline.

17 Claims, 2 Drawing Sheets

(58) Field of Classification Search
USPC ..... 415/211.2
See application file for complete search history.

(56) References Cited

U.S. PATENT DOCUMENTS 2,674,845 A * 4/1954 Pouchot ..... F23R 3/18 415/176
2,744,722 A * 5/1956 Orr ..... F01D 9/065 384/321
2,788,803 A * 4/1957 Greene ..... F02K 1/04 138/37
2,789,416 A * 4/1957 Mirza ..... F01D 9/065 60/266
3,319,593 A * 5/1967 Papst ..... B21D 13/02 114/67 R
3,403,889 A * 10/1968 Ciokajlo ..... F01D 25/162 415/118
4,183,207 A * 1/1980 Libertini ..... F01D 25/162 184/6.11
4,512,158 A * 4/1985 Striebel ..... F01D 9/02 415/914
4,802,821 A * 2/1989 Krietmeier ..... F01D 25/30 415/208.2
4,820,117 A * 4/1989 Larrabee ..... F01D 25/162 415/142
4,987,736 A * 1/1991 Ciokajlo ..... F01D 9/065 415/138
4,993,918 A * 2/1991 Myers ..... F01D 25/162 415/191
5,056,738 A 10/1991 Mercer
5,155,993 A 10/1992 Baughman
5,161,947 A * 11/1992 Eckfeldt ..... F02C 7/20 415/142
5,284,011 A * 2/1994 Von Benken ..... F01D 5/26 248/554
5,729,969 A * 3/1998 Porte ..... F02C 6/08 60/226.1
6,027,305 A * 2/2000 Ng ..... F02C 7/045 415/1
6,139,259 A * 10/2000 Ho ..... B64C 11/20 415/119
6,206,635 B1 * 3/2001 Golm ..... F04D 29/544 415/193
6,439,838 B1 * 8/2002 Crall ..... F01D 5/26 415/119
6,622,475 B2 * 9/2003 Brault ..... F01D 17/105 60/226.3
6,708,482 B2 3/2004 Seda
7,200,999 B2 * 4/2007 Bagnall ..... B64C 21/06 60/226.1
7,266,941 B2 9/2007 Eleftheriou
7,673,461 B2 * 3/2010 Cameriano ..... F01D 5/147 415/142
7,946,806 B2 * 5/2011 Murphy ..... F02C 7/14 415/145
8,029,234 B2 * 10/2011 McCaffrey ..... F01D 5/145 415/142
8,444,378 B2 * 5/2013 Clemen ..... F02K 3/06 415/144
8,523,517 B2 * 9/2013 Clemen ..... F01D 9/00 415/183
8,573,946 B2 11/2013 Power
2004/0109756 A1 * 6/2004 Wakazono ..... F01D 25/162 415/142
2006/0010852 A1 * 1/2006 Gekht ..... B23K 15/0093 60/262
2007/0125066 A1 6/2007 Orlando
2007/0241257 A1 10/2007 Eleftheriou
2007/0289309 A1 12/2007 Zysman
2008/0010970 A1 1/2008 Elefthenou
2008/0022692 A1 1/2008 Nagendra
2008/0098717 A1 5/2008 Orlando
2008/0134687 A1 6/2008 Kumar
2008/0138197 A1 * 6/2008 Green ..... F01D 5/143 415/182.1
2008/0276621 A1 11/2008 Somanath
2010/0135770 A1 * 6/2010 Durocher ..... F01D 9/065 415/69
2010/0272566 A1 * 10/2010 Durocher ..... F01D 9/06 415/208.2
2011/0016883 A1 1/2011 Clemen
2011/0255964 A1 * 10/2011 Clemen ..... F01D 5/141 415/211.2
2011/0268560 A1 * 11/2011 Morvant ..... B64D 33/06 415/145
2012/0243984 A1 * 9/2012 Rishton ..... F01D 25/162 415/213.1

OTHER PUBLICATIONS

Goldstein, Sydney, Low-Drag and Suction Airfoils, Apr. 1948, 26 pages.
Aeronautical Research Council Reports and Memoranda, Tests of a Griffith Aerofoil in the 13ft.×9ft. Wind Tunnel, Mar. 1944, 51 pages.
The American Society of Mechanical Engineers, Combustion and Fuels Industrial and Cogeneration, Jun. 16, 2003, 11 pages.
International Search Report for PCT International Application Serial No. PCT/US2013/078403, completed Apr. 17, 2014.
Office Action for European Application Serial No. 13822078.5-1607, completed Nov. 27, 2017, (5 pages).

* cited by examiner

SUBSONIC SHOCK STRUT

CROSS REFERENCE TO RELATED APPLICATIONS

This application claims priority to and the benefit of U.S. Provisional Patent Application No. 61/783,604, filed 14 Mar. 2013, the disclosure of which is now expressly incorporated herein by reference.

TECHNICAL HELD

The present disclosure generally relates to gas turbine engine struts. More particularly, but not exclusively, the present disclosure relates to gas turbine engine struts having improved performance.

BACKGROUND

Providing gas turbine engine struts having increased thickness with minimal or no impact on performance remains an area of interest. Some existing systems have various shortcomings relative to certain applications. Accordingly, there remains a need for further contributions in this area of technology.

SUMMARY

One embodiment of the present invention is a unique gas turbine engine strut. Other embodiments include apparatuses, systems, devices, hardware, methods, and combinations for improving performance of gas turbine engine struts. Further embodiments, forms, features, aspects, benefits, and advantages of the present application shall become apparent from the description and figures provided herewith.

DETAILED DESCRIPTION

Figure 1:
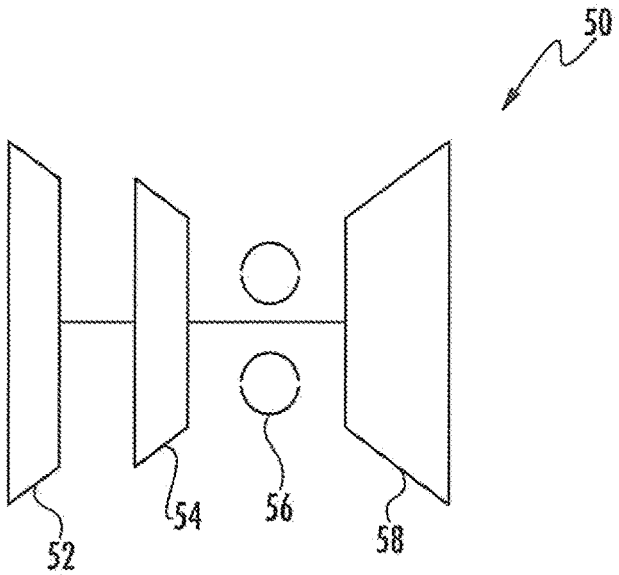
FIG. 1 depicts an embodiment of a gas turbine engine.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIG. 1, one embodiment of a gas turbine engine 50 is depicted which includes a fan 52, compressor 54, combustor 56, and turbine 58. Air is received into and compressed by the compressor 54 prior to being delivered to the combustor 56 where it is mixed with fuel and burned. A flow of air and products of combustion is then delivered to the turbine 58 which expands the flow stream and produces work that is used to drive the compressor 54 as well as to drive the fan 52. The fan 52 is used to develop thrust by accelerating air through a bypass passage 66 which is exhausted out of the rear of the engine 50.

The gas turbine engine 50 can be used to provide power to an aircraft and can take any variety of forms. As used herein, the term "aircraft" includes, but is not limited to, helicopters, airplanes, unmanned space vehicles, fixed wing vehicles, variable wing vehicles, rotary wing vehicles, unmanned combat aerial vehicles, tailless aircraft, hover crafts, and other airborne and/or extraterrestrial (spacecraft) vehicles (e.g. dual stage to orbit platform). Further, the present inventions are contemplated for utilization in other applications that may not be coupled with an aircraft such as, for example, industrial applications, power generation, pumping sets, naval propulsion, weapon systems, security systems, perimeter defense/security systems, and the like known to one of ordinary skill in the art.

Though the engine 50 is depicted as a single spool engine, other embodiments can include additional spools. The embodiment of the engine 50 depicted in FIG. is in the form of a turbofan engine, but it will be appreciated that some embodiments of the gas turbine engine can take on other forms such as, but not limited to, open rotor, turbojet, turboshaft, and turboprop. In some forms, the gas turbine engine 50 can be a variable cycle and/or adaptive cycle engine.

In any of the embodiments of the gas turbine engine 50, various turbomachinery components will be provided which include rotatable blades and stationary vanes, whether of the static or pivoting kind. In addition, the gas turbine engine 50 may include a variety of struts that extend across a flow path that can be used to provide structural support and/or provide a passageway for services such as, but not limited to, electrical, hydraulic, and/or pneumatic. As will be appreciated, struts useful to provide structural support and/or passageways for services typically have increased thickness to chord ratios relative to gas turbine engine blades and vanes. In fact, in some applications such as a strut located in an exit area of a high-pressure compressor, the thickness of the strut in a pre-diffuser placed in that location can be very large and result in a significant loss and blockage performance penalty. The struts, blades, and vanes typically have an airfoil-like shape that includes a leading edge, a trailing edge, a top, and a bottom. These airfoil like shapes can be used to change a pressure of a working fluid flowing through a duct, the shapes can be used to alter direction of the working fluid, and, in some forms, the shapes can impart relatively lithe pressure and/or direction change to the working fluid. Various embodiments will be described further below regarding a particular airfoil-like shape useful within the gas turbine engine 50.

The struts etc can be a standalone component that is integrated into a gas turbine engine with other structure (e.g. through fasteners, bonding techniques, etc) and alternatively can be integral with other structure. To set forth just one non-limiting example, a strut can used in a gas turbine engine diffuser and can be integral with end walls and a splitter(s) of the gas turbine engine diffuser. The strut can be integral with other endwalls in other gas turbine engine components. In some forms, the strut is standalone and is later fastened internal to the gas turbine engine.

Figure 2:
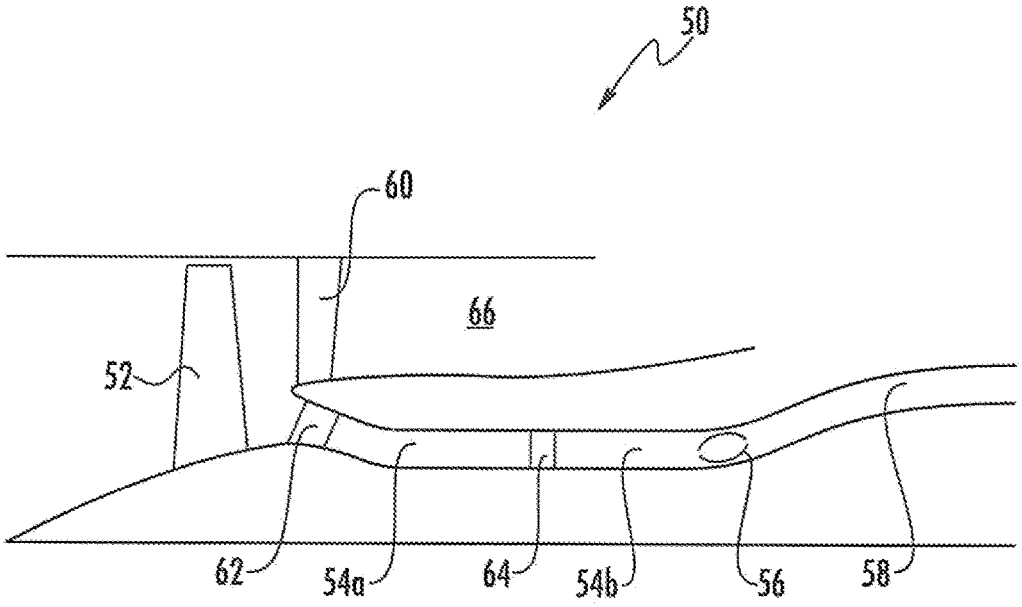
FIG. 2 depicts an embodiment of the gas turbine engine having struts.

Turning now to FIG. 2, one embodiment of the gas turbine engine 50 is depicted as a three spool turbofan engine having the fan 52, intermediate compressor 54*a*, high-pressure compressor 54*b*, combustor 56, and turbine 58. It will be appreciated that the turbine 58 depicted in FIG. 2 is shown for sake of simplicity and, although a single turbine is depicted, it will be appreciated that three spool engines typically have 3 different turbines. The gas turbine engine 50 also includes struts 60, 62, and 64 disposed in various locations of the gas turbine engine 50. The strut 60 is located in a bypass passage 66; the strut 62 is disposed between the fan 52 and the intermediate compressor 55*a*; and the strut 64 is disposed between the intermediate-pressure compressor 54*a* and the high-pressure compressor 54*b*. Various embodiments of an airfoil member described below can be used for any of the members having airfoil-like properties including the struts 60, 62, and 64.

Figure 3:
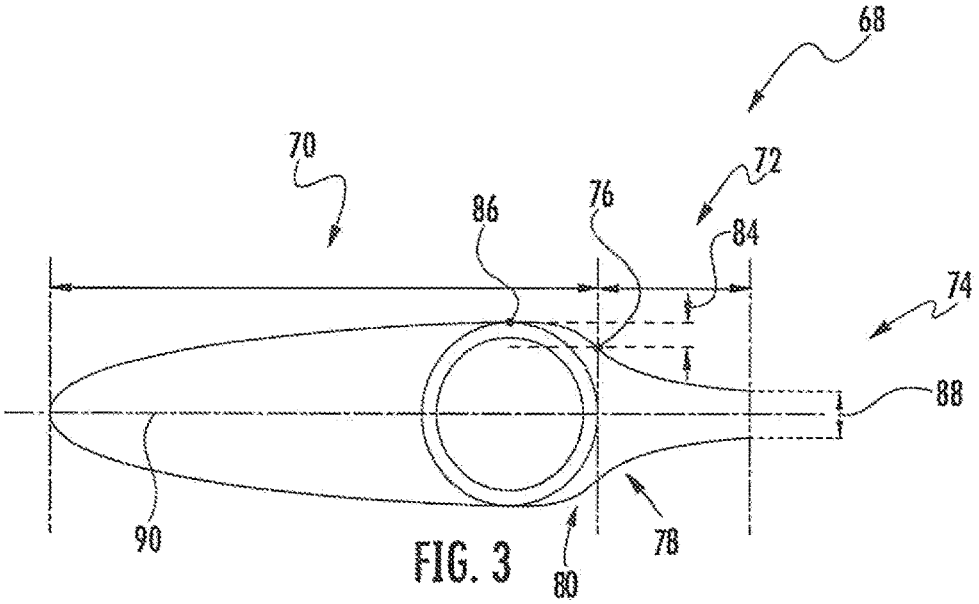
FIG. 3 depicts an embodiment of a gas turbine engine strut.

One depiction of an airfoil member useful in a variety of locations within the gas turbine engine 50 is depicted in FIG. 3 which illustrates a strut 68 having a forebody 70 and an aft body 72. The aft body 72 is generally the portion of the strut 68 aft of a maximum thickness that extends to a trailing edge 74 and that includes a curvature distribution having a discontinuity. In the illustrated embodiment, the discontinuity is in the form of an inflection point 76. As will be discussed further below, the curvature distribution is useful to create a "subsonic shock" that allow for struts having increased thickness-to-chord ratios in reduced trailing edge thicknesses, improved pressure recovery, and reduced loss and blockage generation of the flow over the struts. In some forms, the subsonic shock is also useful to fix the separation of the flow over the struts at the strut trailing edge location where "at the trailing edge location of the strut" includes exactly the precise corner of the strut in the illustrated embodiment, but also includes some small amount of variation as would be appreciated by those in the art. As used herein, the term "subsonic shock" is used to generally refer subsonic flow that, because of the nature of a flow surface, induces a profile in coefficient of pressure that includes a "rise" and subsequent pressure "fall" in the axial downstream direction similar in character to pressure rises and subsequent falls seen in association in shocks associated with supersonic flow.

Figure 4A:
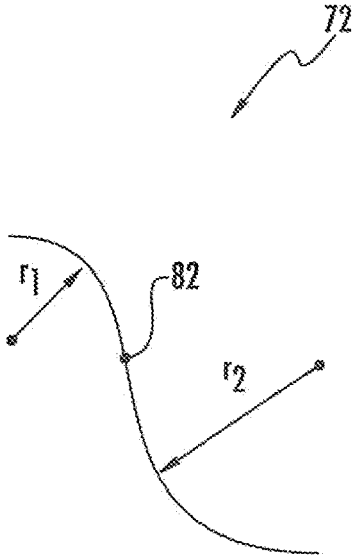
FIG. 4A depicts an example curvature distribution.
Figure 4B:
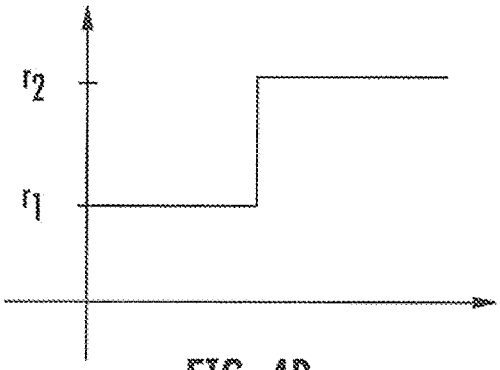
FIG. 4B depicts an example curvature distribution.

A discontinuity in the aft body 72 useful to generate the subsonic shock is in the form of a discontinuous change in second derivative of arc length which can take the form of the inflection point 76. One example of a discontinuity in the second derivative of arc length is shown in FIG. 4A and FIG. 4B. The discontinuity is formed by an upstream portion 78 of the aft body 72 having a constant radius curve of radius r1 that transitions into a downstream portion 80 of the aft body 72 having a constant radius curve of radius r2. An inflection point 82, shown in FIG. 4A, illustrates the change in curvature of the aft body 72. FIG. 4B illustrates a plot of radius of curvature of the portion of the aft body 72 depicted in FIG. 4A. As will be appreciated, the change in radius from r1 to r2 creates discontinuity in the curvature distribution at the point at which the curves change radius. Other examples are also contemplated herein. For example, the aft body 72 can be obtained using NURB splines, such as, but not limited to, 4th order NURB splines with 6 control points. A curvature inflection point in the aft body 72 can be created by a non-smooth distribution of the NURB-spline control points at the desired location of the inflection point. The pressure recovery attained downstream of the inflection point allows a thickness of the trailing-edge to be reduced by a factor of 2 in some embodiments. Such result can yield a significant improvement and dump loss and blockage performance. Though the aft body 72 is illustrated having a discontinuity in the curvature distribution, derivative continuity can be maintained between the forebody 70 and the aft body 72.

Returning now to FIG. 3, and with continuing reference to FIGS. 4A and 4B, the strut 68 also has various other characteristics. The upstream portion 78 can extend a distance 84 in the thickness direction away from a point of maximum thickness 86. A distance in the thickness direction from the inflection point 76 to the trailing edge 74 can be the same as, greater than, or less than the distance 84. The trailing edge 74 illustrated in FIG. 3 is depicted as blunted and having a squared off shape with distinct corners. The thickness 88 of the blunt trailing edge 74, and its precise shape, can vary from embodiment to embodiment and, although the illustrated proportion of the trailing edge to other parts of the strut 68 can be used in some embodiments, the proportion of the trailing edge to other parts of the strut 68 can vary in other embodiments from that depicted in the figure. The strut 68 can be symmetrical about the centerline 90.

In some embodiments, the downstream portion 80 acts to suppress the growth in shape factor of the strut boundary layer and provides an adequate reattachment length for the flow such that the flow separates only at the trailing edge point of the strut geometry.

In some embodiments of the strut 68, the pressure recovery due to a duct in which the strut 68 is disposed can be terminated at a meridional plane coincident with the strut maximum thickness 86. In those embodiments in which the strut 68 is situated in a pre-diffuser duct, the duct end-walls can be terminated at the meridional plane coincident with the strut maximum thickness 86. In some additional and/or alternative embodiments of the strut 68, the trailing edge 74 of the strut 68 can coincide with a trailing edge of an end wall but in other forms the trailing edge 74 can either be located upstream or downstream of the trailing edge of the end wall.

In some forms, the strut 68 can include active boundary layer flow control. For example, an aperture or series of apertures can be formed in the aft body 72 through which boundary layer is withdrawn via a suction action. Such active flow control can be used to further control boundary layer and achieve a more aggressive pressure recovery and an increased flow stability for high-performance engine designs.

The forebody 70 can include a shape determined from a variety of approaches. In some applications, the forebody 70 can be designed to ensure a strut profile from the leading edge of the strut up to its maximum thickness that subjects the flow to a minimum amount of accelerations by minimizing the value of the pressure suction peak, resulting in the highest strut surface pressure possible at the maximum thickness point before the next phase of pressure recovery across the "subsonic shock". One particular approach useful to designing the forebody 70 will be appreciated in the literature, such as a reference "A New Method of Two-Dimensional Aerodynamic Design" by Lighthill, M. J., A.R.C. RM No. 2112, 1945, which is incorporated herein by reference in its entirety.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising a gas turbine engine subsonic strut having an airfoil shape structured to be disposed in a flow path having subsonic flow and including a forebody located forward of a maximum thickness of the strut and an aft body located aft of the maximum thickness, the aft body of the gas turbine engine subsonic strut having an inflection point that produces a subsonic shock pressure recovery, the aft body including an upstream portion having a constant radius curve of a first radius that transitions at the inflection point to a downstream portion having a different constant radius curve, wherein the inflection point is structured to initially encourage flow separation while the aft body is structured to provide a length to reattach the flow while still decelerating the flow.

2. The apparatus of claim 1, wherein the forebody upstream of a maximum thickness has a profile configured to exert relatively little acceleration on a working fluid passing over the gas turbine engine subsonic strut.

3. The apparatus of claim 1, wherein the forebody is axially longer than the aft body.

4. The apparatus of claim 1, wherein the subsonic strut is one of a diffuser strut and a bypass duct strut, and wherein the subsonic strut is symmetric about a plane of symmetry.

5. The apparatus of claim 1, wherein the aft body is shaped to suppress a growth in shape factor.

6. The apparatus of claim 1, wherein the inflection point is a discontinuous change in the curvature distribution of strut surface geometry.

7. The apparatus of claim 1, which further includes an active boundary layer suction aperture located downstream of the inflection point, the active boundary layer suction aperture used in concert with the inflection point to achieve a more aggressive pressure recovery and an increased flow stability.

8. The apparatus of claim 1, wherein the subsonic strut is disposed in a diffuser having end walls, and wherein a trailing edge of the subsonic strut is at or forward of a trailing edge of the end walls.

9. An apparatus comprising a symmetric gas turbine engine static airfoil member having a forward end portion positioned forward of a maximum thickness and an aft end portion positioned aft of the maximum thickness, the aft end portion having a top side symmetric with a bottom side, wherein each of the top side and bottom side include a discontinuous change in curvature distribution, the aft end portion including an upstream portion having a constant radius curve of a first radius that transitions at the inflection point to a downstream portion having a different constant radius curve, wherein an inflection point along the discontinuous change in curvature distribution produces a subsonic shock, which further includes aspiration control structured to remove at least a portion of a boundary layer flowing along the symmetric gas turbine engine static airfoil member.

10. The apparatus of claim 9, wherein the symmetric gas turbine engine static airfoil member is disposed in a transition duct of a gas turbine engine.

11. The apparatus of claim 9, wherein the symmetric gas turbine engine static airfoil member is a gas turbine engine strut.

12. The apparatus of claim 9, wherein the symmetric gas turbine engine static airfoil member is integral with an endwall.

13. The apparatus of claim 12, wherein the endwall extends at least to the trailing edge of the symmetric gas turbine engine static airfoil member.

14. The apparatus of claim 9, wherein the aft end portion is shaped to suppress a growth in shape factor.

15. The apparatus of claim 9, wherein the forward end portion upstream of a maximum thickness has a profile configured to exert relatively little acceleration on a working fluid passing over the symmetric gas turbine engine static airfoil member.

16. An apparatus comprising a gas turbine engine strut having a leading edge, a trailing edge, and a maximum thickness disposed between the leading edge and trailing edge, the gas turbine engine strut including means for inducing a subsonic shock, the inducing means comprising an upstream portion having a constant radius curve of a first radius that transitions at an inflection point to a downstream portion having a different constant radius curve.

17. The apparatus of claim 16, which further includes an active boundary layer suction aperture to remove at least a portion of a boundary layer located downstream of the inducing means, the active boundary layer suction aperture used in concert with the inducing means to achieve a more aggressive pressure recovery and an increased flow stability.

* * * * *